United States Patent [19]

Meister

[11] Patent Number: 4,698,487

[45] Date of Patent: Oct. 6, 1987

[54] PROCESS AND APPARATUS FOR THE HEAT TREATMENT OF MEALS

[76] Inventor: Siegfried Meister, Siemensstr. 2, 8910 Landsberg a. Lech, Fed. Rep. of Germany

[21] Appl. No.: 760,883

[22] Filed: Jul. 31, 1985

[30] Foreign Application Priority Data

Aug. 3, 1984 [DE] Fed. Rep. of Germany ..... 3428648
Dec. 21, 1984 [DE] Fed. Rep. of Germany ..... 3446863

[51] Int. Cl.[4] ..... H05B 1/02
[52] U.S. Cl. ..... 219/506; 219/401; 219/413; 219/491; 219/494; 126/20; 126/21 A; 165/59; 165/61; 99/333
[58] Field of Search ..... 219/400, 401, 413, 419, 219/491, 490, 494, 497; 126/20, 21 A, 21 R; 165/58, 59, 61, 65; 99/328, 333

[56] References Cited

U.S. PATENT DOCUMENTS

| | | | |
|---|---|---|---|
| 3,888,303 | 6/1975 | Skala | 165/61 |
| 4,103,736 | 8/1978 | Colato et al. | 165/61 |
| 4,503,502 | 3/1985 | Chapin | 99/333 |
| 4,516,012 | 5/1985 | Smith et al. | 126/21 A |
| 4,539,469 | 9/1985 | Gigandet | 219/412 |

*Primary Examiner*—M. H. Paschall
*Attorney, Agent, or Firm*—Hill, Van Santen, Steadman & Simpson

[57] ABSTRACT

The invention relates to a process for operating an apparatus having a cooking area for the heat treatment of food, the heated cooking area being at least partly actively cooled prior to the introduction of new food.

The invention also relates to an apparatus for the heat treatment of food with a cooking area, in which an inadequate cooking area temperature can be indicated prior to starting a heat treatment, e.g. by means of an optical and/or acoustic signal generator and/or whose cooking area is at least partly actively coolable.

24 Claims, 8 Drawing Figures

PROCESS AND APPARATUS FOR THE HEAT TREATMENT OF MEALS

BACKGROUND OF THE INVENTION

The present invention relates to a process and to an apparatus for the heat treatment of meals.

The invention relates to a process for operating an apparatus for the heat treatment of meals which has a cooking area.

Such apparatuses can be operated in various operating modes, particularly with hot air or steam only. It is also possible to operate such apparatuses with a mixture of steam and hot air.

Generally, particular cold food or meals are treated by steaming. Deep-frozen food or meals are thawed and heated in this way. Other preparation processes such as boiling, roasting or baking are carried out in hot air operation or in a so-called combination steaming operation, in which the food is subject to the action of a mixture of steam and hot air. On changing between these different operating modes, certain inadequacies occur in practice. Particularly when operating the apparatus in hot air operation, temperatures well above 100° C. prevail in the cooking area. If, following such a hot air treatment, food or meals introduced afresh into the cooking area are to be treated by means of steam, then, because of the still very high temperatures prevailing in the cooking area, such food is subject to crust formation or burn at specially exposed points. This more particularly applies to those portions of the meals or food adjacent to the cooking area walls.

To avoid the aforementioned inadequacies, the cooking area door is normally kept open until an adequate cooling has taken place. However, frequently the necessary cooking phase on passing between two operating modes, e.g. passing from hot air operation to steaming, is overlooked, so that food subsequently introduced is affected in the aforementioned manner. However, if a suitable time is allowed to pass before introducing the new meals or food into the cooking area it is very difficult for an operator to establish when the cooking area has cooled sufficiently to enable them to be introduced.

In view of the aforementioned inadequacies of the known process for operating an apparatus having a cooking area, the process problem of the present application is to provide a process for operating an apparatus having a cooking area, which permits a problem-free change between different operating modes of such an apparatus.

SUMMARY OF THE INVENTION

To solve this problem, the invention initially provides a teaching of at least partly actively cooking the heated cooking area prior to the introduction of new food. As a result of such an active cooling, which can be initiated by an operator, but which can also follow automatically on the treatment of food, the cooking area is reliably cooled to an adequate temperature. Once initiated, active cooling can in particular take place over a predetermined uninfluencable period of time so that, on the basis of empirical values, an adequate cooling can be achieved even in the case of maximum heating of the cooking area. The once initiated cooling can naturally be regulated, i.e. so that the cooling is only performed until a predetermined cooking area temperature is reached. However, active cooling means that one does not wait until the cooking area has given off an adequate amount of heat by automatic heat exchange with the ambient, and that instead special cooling measures are taken.

As a development of the process, the cooling is performed through direct or indirect heat exchange.

The cooking area can initially be cooled from the outside, e.g. blowing can take place against said cooking area, or cooling medium can be introduced thereinto from the outside through the open cooking area door or other openings thereto and this can be e.g. ambient air, as defined hereinafter.

In addition, the cooking area can also be cooled from the inside, which is linked with the advantage that the heat dissipation from the cooking area can be performed via specific guides, i.e. the operator cannot in an undesirable manner be in contact with the hot air or superheated steam flowing out of the cooking area.

As indicated, the present process can be developed in that there is an exchange of an internal cooking area atmosphere with an ambient atmosphere. The latter can be replaced by a special cooling atmosphere, e.g. in the form of a cooling air supply, which is forced into the cooking area to exchange with the internal atmosphere.

However, it is not absolutely necessary to cool the complete cooking area and it can in fact be adequate to merely cool one or more components therein, such as the cooling baffles and other objects. This is linked with the advantage in the case of such a development of the process, the additionally required units can be kept small, but the cooling effect is adequate, because the heated atmosphere in the cooking area moves past the cooled component by convection. Simultaneously such a component is generally a radiant energy interchange with boundary walls or further components of the cooking area, so that this also leads to a cooling effect.

Another development of the process is that the cooling of such cooled components is aided by forced convection. For example, this can take place by blowing against the components from the outside or, if the components are cooled from the inside by a gaseous coolant, by increased flow rate of the coolant.

The indicated developments of the process can be performed not only alternately, but also in combined manner, e.g. an external cooling of the cooking area together with a cooling of the components, an internal cooling simultaneously with an external cooling of the cooking area, an exchange of the internal atmosphere of the cooking area with the ambient temperature simultaneously with a cooling of components and the like.

From the apparatus standpoint and with respect to the aforementioned inadequacies, the problem of the present invention is to provide an operationally more advantageous apparatus, particularly one permitting a problem-free change between different operating modes thereof. This problem is solved by the invention providing the teaching of so constructing and further developing the apparatus, that an inadequate cooking room temperature for initiating heat treatment can be indicated, e.g. by means of an optical and/or acoustic signal generator. Thus, in the simplest form the Expert is provided with the teaching of providing a heat sensor connected with the critical regions of the cooking area, which makes it possible to establish whether or not new food can be safely introduced into the cooking area. According to a development of this teaching the signal generator is a component of one or each apparatus control circuit initiating a specific operating mode. In particular, the signal generator can be a component of an apparatus control circuit initiating the steaming operating mode. The fact that the signal generator is a component of a control circuit means, within the scope of the invention and as will be described in greater detail hereinafter, that for as long as the signal generator is activated, namely when the temperature is unacceptably high, the operating mode, e.g. steaming cannot be initated.

As indicated, the signal generator can be subject to the action of a heat sensor arranged in the cooking area, the heat sensor preferably being positioned in the vicinity of the top of the latter. However, it is also possible to position the heat sensor in some other point, e.g. on the bottom of the cooking area.

To the extent that reference is made hereinbefore and hereinafter to an apparatus for the heat treatment of food, this is in particular an apparatus, with the present additional measures, and as described in the documents of German Utility Model 81 31 827.8. The disclosure of this utility model is consequently incorporated completely into the description of the present invention.

As a further development of the apparatus, its cooking area is at least partly actively coolable, i.e. units are provided leading to a rapid cooling of the cooking area, changing from one operating mode to another, particularly to the steaming operating mode.

For this purpose, the boundary walls of the cooking area can at least partly be constructed in the form of an air/air heat exchanger or an air/liquid heat exchanger. When constructed as an air/air heat exchanger, parts of the boundary walls of the cooking area are constructed as hollow bodies, through which can be passed or forced air or some other gaseous medium for cooling purposes. Correspondingly the boundary walls can also be constructed in such a way that a liquid coolant can be passed therethrough, which advantageously leads to a higher thermal capacity, i.e. optionally only smaller regions of the cooking area walls have to be constructed in this way. Naturally, the cooking area walls can be constructed in double-shell manner or the cooking area can be enveloped by a second chamber, through which flows a gaseous or liquid coolant.

The aforementioned measures described in connection with the complete cooking area can naturally also additionally or solely be carried out with respect to one or more of the components.

Alternatively, or in partial regions additionally to the measure of surrounding the cooking area by a second chamber, or constructing its walls in two-shell manner, the cooking area walls can be provided on one side with coolant lines, e.g. arranged helically directly on an outer boundary wall of the cooking area. Correspondingly such coolant lines or coils can engage the boundary walls within the cooking area, or in fact the boundary walls can be replaced by such coolant lines or coils.

The further special teaching of the present invention relates to a development of the apparatus in which cooling fluid can be sprayed into the cooking area. For this purpose, spraying nozzles extending into the area of the cooking area can be provided. The spraying of the coolant, e.g. water, can in the case of a "combination atmosphere" in the interior of the cooking area, i.e. an atmosphere partly consisting of steam and partly consisting of hot air, lead to the steam being condensed, so that a vacuum is formed in the cooking area and an additional cooling action is achieved through the ambient air flowing in from the outside. Otherwise the main effect of the spraying nozzle is that the boundary walls of the cooking area are sprayed with cooling fluid and remove heat therefrom, by evaporation.

In addition or alternatively thereto, it is also possible to construct the apparatus in such a way that the boundary walls and/or components of the cooking area are wettable with cooling fluid within the cooking area and/or from the outside (i.e. in the case of the internal components). This makes it possible to achieve a more planned cooling, i.e. only those surfaces are subject to cooling fluid action, whose cooling is necessary for the treatment of the cooking material without the formation of crusts and the like, whilst other surfaces and parts of the cooking area are not cooled, because the cooling is intended to take place so as to remove the inadequacies and not just to remove heat from the cooking area.

According to a development, wetting lines extending up to the boundary walls and/or the components and issuing inside and/or outside the cooking area are provided.

A further development of the apparatus is that by means of a suction of compression fan or blower it is possible to exchange an internal atmosphere of the cooking area with an ambient atmosphere. For this purpose, an independent access can be provided to the cooking area via a suction or pressure pipe, but existing possibilities can also be used. For example in an apparatus described in German Utility Model 81 31 827, a fan wheel is provided which, to the extent that it does not satisfy the requirements, can be modified with respect to a suction action and then an opening to the ambient atmosphere, e.g. controllable by a flap can be provided, which is associated with the pressure or suction side of the fan or blower.

According to a further teaching by means of a suction or pressure blower, an exchange of the internal atmosphere by a separate cooling atmosphere is possible. In particular, this special cooling atmosphere can be compressed air and from the apparatus standpoint a separate compressed air access to the cooking area is realized. A valve can then be arranged within this compressed air access, which is controllable as a function of the internal temperature of the cooking area.

As stated hereinbefore in connection with the process measures, also with regards to the aforementioned apparatus measures, a combination of the different cooling measures can be realized.

In connection with the signalling by a signal generator and the coupling of the latter with a heat sensor, it can in particular be provided that each of the cooling devices is controllable as a function of the heat sensor by a control circuit initiating a specific operating mode. It can in particular be appropriate for each of the cooling devices to be connected in parallel with the signal generator.

The invention also makes it possible, if desired, prior to any opening of the cooking area to separate the steam located therein, so that the environment is not prejudiced by outflowing condensing steam. This procedure falls within the inventive concept and is particularly advantageous.

Further details of the invention can be gathered from the subclaims.

BRIEF DESCRIPTION OF THE DRAWINGS

The invention is described in non-limitative manner hereinafter relative to embodiments and the attached drawings.

DESCRIPTION OF THE PREFERRED EMBODIMENTS

Figure 1:
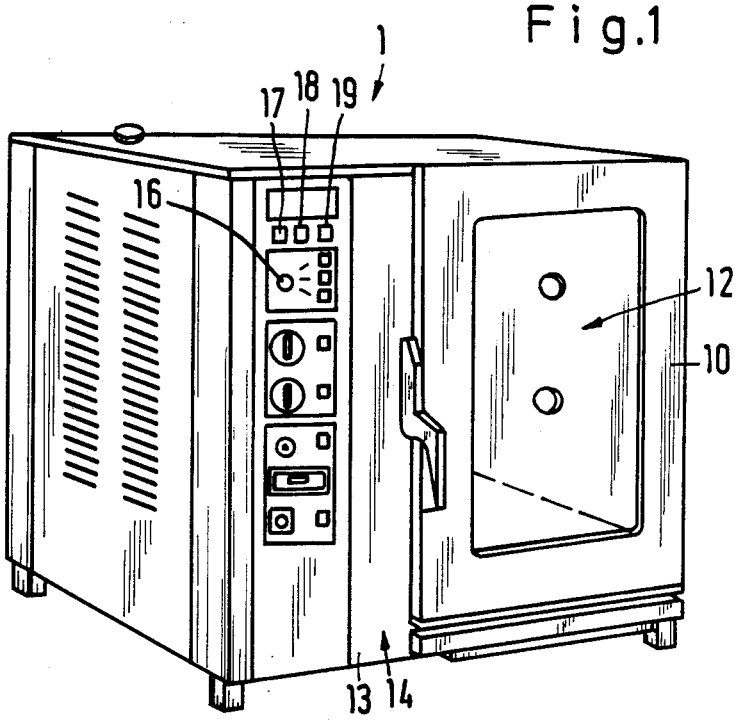
FIG. 1 shows a diagrammatic perspective view of an apparatus having the features according to the invention.

An apparatus 1 is described and represented, for the heat treatment of food or meals in general. As can be gathered from FIG. 1, apparatus 1 has a cooking area 12, which is accessible by means of a cooking area door 10. Food or meals can be introduced into the cooking area 12 on racks for heat treatment purposes. Laterally with respect to the cooking area door 10, on the front 14 of the represented apparatus, which can also be called a combination steamer, are provided a plurality of controls and indicator panels, whereof the operating mode selection switch 16 is particularly indicated. Behind the indicator panels 17, 18, 19 are provided lamps or light-emitting diodes, which light up in a manner to be described hereinafter, at specific operating phases of apparatus 1. An operational part of the apparatus 1 is housed to the rear of the controls and the portion 13 of apparatus front 14 following onto the cooking area door 10. With regards to the further explanation of apparatus 1 and particularly the operating part thereof, reference is once again made to German Utility model 81 31 827, whose content is fully incorporated into the present description.

The operating part is proviced behind a partition 22 (cf. FIG. 2) with a boiler 24, in which is arranged a boiler heating system 26. From the upper part of boiler 24, a steam supply pipe 28 leads through partition 22 into the interior of an antechamber 30, which has a blower 32 and an electrical heating system or heating coil 34 surrounding the blower. Towards cooking area 12 the antechamber 30 is bounded by a sheet metal plate 36 which also constitutes a component in the aforementioned sense, which is arranged in spaced manner with respect to the side walls, i.e. bottom 38 and top 40 of cooking area 12, and which has a central suction port 42. Above blower 32 and heating system 34, a steam supply pipe 28 issues into antechamber 30. Below top 40 of cooking area 12 a heat sensor 44 is fixed to top 40 in cooking area 30.

A water level switch 46 is fixed in boiler 24, and comprises an elongated tube 48, whose longitudinal direction extends at right angles to the water surface 47 of the water 49 contained in boiler 24. Tube 48 contains an upper read contact positioned approximately at the highest water level desired in boiler 24. Tube 48 also contains a lower reed contact at a level which, if water surface 47 dropped below it, would prejudice the operating boiler heating system 26 through an inadequate water level in boiler 24.

Along tube 48 passes a float 50, which can e.g. comprise a hollow ball, which is axially traversed by a pipe embracing tube 48. In float 50 is fixed a permanent magnet of such a strength, that its field intensity opens one of the two reed contacts, if the float faces the particular reed contact on tube 48. The two poles of the two lower and upper reed contacts are connected via an electric line 52 to control system 60 of apparatus 1. The necessary power is supplied to the boiler heating system 26 by control circuit 60 via a lead 61 and a further line 62. A further two-conductor line 54 leads from the control system 60 to the light positioned behind indicator 18. Another two-conductor line 56 leads from control system 60 to the light positioned behind indicator 17. In addition, a further two-conductor line 58 leads from control system 60 to heat sensor 44.

Figure 2:
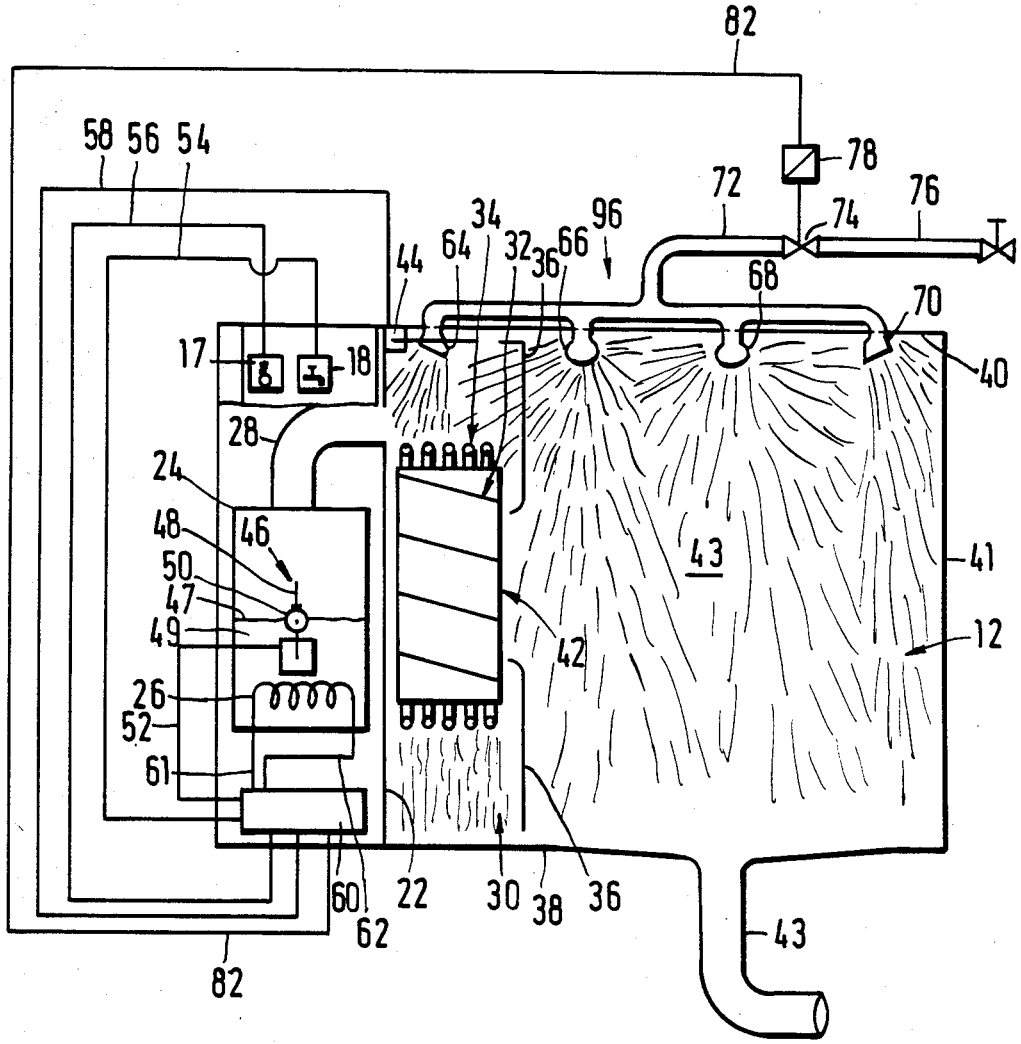
FIG. 2 shows a diagrammatic representation of the cooking area with the operating part of the apparatus according to FIG. 1.

In the top of cooking area 12 and antechamber 30 are fixed, in the embodiment according to FIG. 2, a plurality of spraying nozzles 64, 66, 68, 70, which are connected to a common waterline 72, which contains a valve operated by a field coil 78 and which is connected on the upstream side with a water supply line 76. Field coil 78 is connected via a control line 82 to control system 60. Spraying nozzles 64, 66, 68, 70 are directed on to walls 22, 36, 41 and 43, as well as the top 40 of the cooking area and spray them with water passed out of line 76 when valve 74 is open. Together they form the spraying mechanism 96 of apparatus 1.

Figure 3:
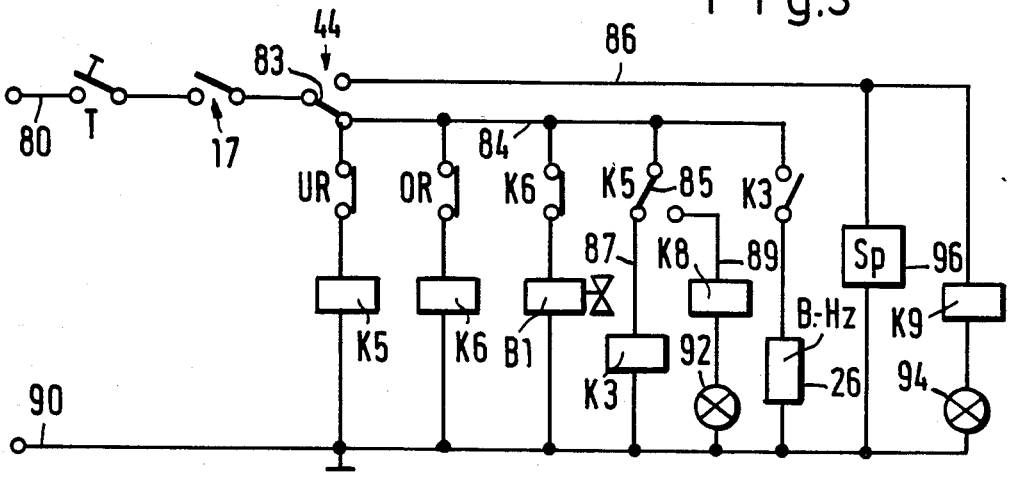
FIG. 3 shows a circuit diagram of the control system of the apparatus according to FIG. 1.

The operation of the embodiment shown in FIG. 2 and which is in principle realizable in the same way in the case of the embodiments to be described hereinafter, is illustrated by means of the circuit diagram shown in FIG. 3, which represents a detail of control system 60. In the case of apparatus 1 being connected to a power supply, there is a voltage between lines 80 and 90. If in the manner shown in FIG. 1, the cooking area door 10 is closed, the door switch T is closed. If the selection switch 16 is at the "steam" operating mode, switch 17 is simultaneously closed. The further operation of the apparatus 1 or the steamer is then dependent on the position of switch arm 81 of heat sensor 44. If the temperature detected by heat sensor 44 is below e.g. 110° C., switch arm 83 assumes the position shown in FIG. 3, in which it connects electric line 84 with line 80 in a conductive manner (switches T and 17 are closed).

It is assumed that boiler 24 contains sufficient water for float 50 to be located between the upper and lower reed contacts, i.e. both reed contacts are closed. The upper reed contact is designated OR in FIG. 3 and the lower reed contact UR. Solenoid valve B1 is opened by means of the working contact K6 of relay K6 which is currentless when OR is open, so that the water supply is interrupted. When UR is closed via relay K5 line 85 is connected to 87, so that a current flows through relay K3, and working contact K3 closes, so that boiler heating system 26 receives power via line 84 and 90, and then current is produced in boiler 24.

If a fault occurs in the water supply for boiler 24, e.g. through the tap thereof being switched off, so that boiler 24 receives no water supply despite valve B1 being open, as steam production progresses, the water level 47 drops to such an extent that float 50 opens the lower reed contact UR. The relay K5 then becomes voltageless, so that switch arm 85 of reversing switch K5 now connects line 84 to line 89. With relay K3 currentless, working contact K3 drops out, so that the boiler heating system 26 no longer receives any power. In the last-described position of switch arm 85, line 84 supplies line 89 a voltage to a flashing indicator K8, which supplies optical flashing indications to the following light 92 positioned behind window 18. On the latter can be printed a symbol indicating the water deficiency. This ensures that the boiler heating system 26 does not run dry, and become damaged, so that steaming is no longer possible.

Apparatus 1 takes on another operating phase when, with switches T and 17 closed, heat sensor 44 detects a temperature above approximately 120° C. in the cooking area. In this case, switch arm 83 links line 80 with line 86. By means of line 86, voltage is then supplied to the flashing indicator K9, so that the light 94 behind indicator panel 17 flashes. A symbol can be printed on panel 17, which can be understood as a warning against introducing food into cooking area 12 because of the excessive temperature therein.

Simultaneously, spraying mechanism 96 receives current via line 86, i.e. control system 60 supplies a signal operating coil 78 via control line 82, so that valve 74 opens and the aforementioned walls of cooking area 12 are sprayed. Thus, within a short time the temperature within cooking area 12 drops to such an extent that the heat sensor 44 reverses its switch arm 83, so that line 80 is electrically connected to line 84 and the "steaming" operating mode can be realized by apparatus 1.

If water level 47 in boilder 24 rises to such an extend that float 50 opens the upper reed contact OR, relay K6 receives no current, so that working contact K6 opens and valve B1 closes.

The operating mode "combination steaming" is not shown, in which the food in the cooking area is treated both with steam and with hot air. It falls within the scope of the present invention to additionally connect the water level switch 46 to a further control circuit, which releases the "combination steaming" operating mode. Thus, an inadequate water level is always indicated if steam is to be produced in boiler 24, either for steaming only or for "combination steaming".

As can be gathered from the above, an apparatus 1 according to the invention can be operated in a process in which the heated cooking area 12 is at least partly actively cooled prior to introducing new food, namely through automatically operating spraying mechanism 96 when the temperature within cooking area 12 are above roughly 110° C.

Figure 4:
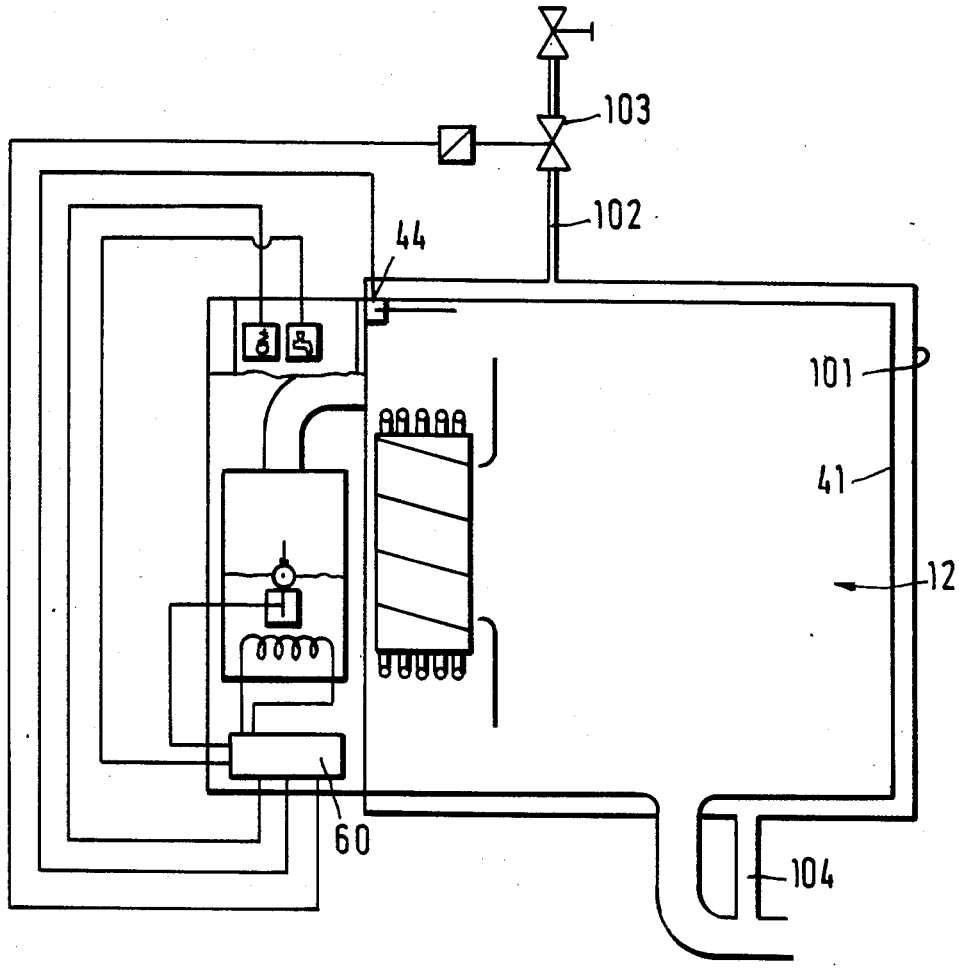
FIG. 4 shows an apparatus according to the invention with a cooking area having a second chamber.

In the embodiment shown in FIG. 4, cooking area 12 is cooled from the outside, namely by a cooling medium which can flow in between cooking area wall 41 and the couble chamber wall 101. For this purpose a cooling medium supply line 102 is provided, whose stop valve 103 is operable in the aforementioned manner via control system 60 of apparatus 1, as a function of the cooking area internal temperature detected by heat sensor 44. By means of a drain line 104, the cooling medium can flow out or, after processing, can be recirculated.

Figure 5:
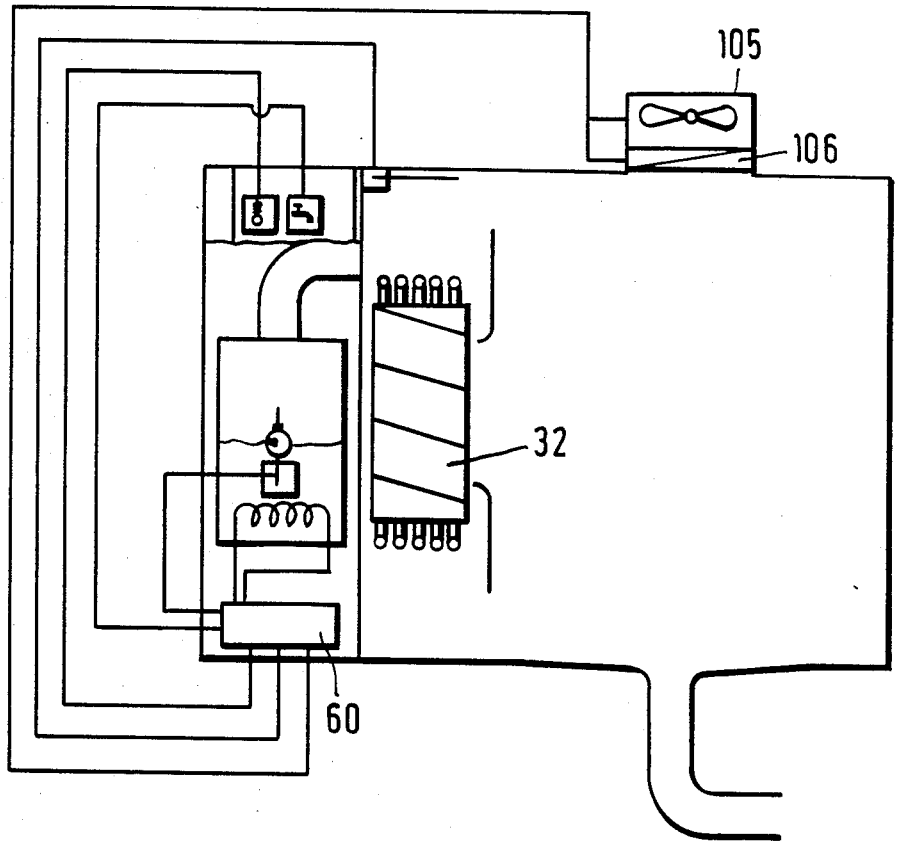
FIG. 5 shows an apparatus according to the invention with a fan cooperating with the cooking area.

In the embodiment shown in FIG. 5, the fan 105 is provided, which can also be activated in the aforementioned sense by control system 60. Upstream of fan 105 can be provided a heat exchanger 106, which is advantageously linked with the external atmosphere and sucks in the same and which, comparably to an arrangement of a refrigerating unit in an air conditioning plant, is through-flown by coolant and further cools the air sucked in and blown into cooking area 12. Not shown, but fundamentally possible is also a use of the (heating) blower 32 as a "cooling" fan by providing a connection to the outside area on the pressure side of blower 32.

Figure 6:
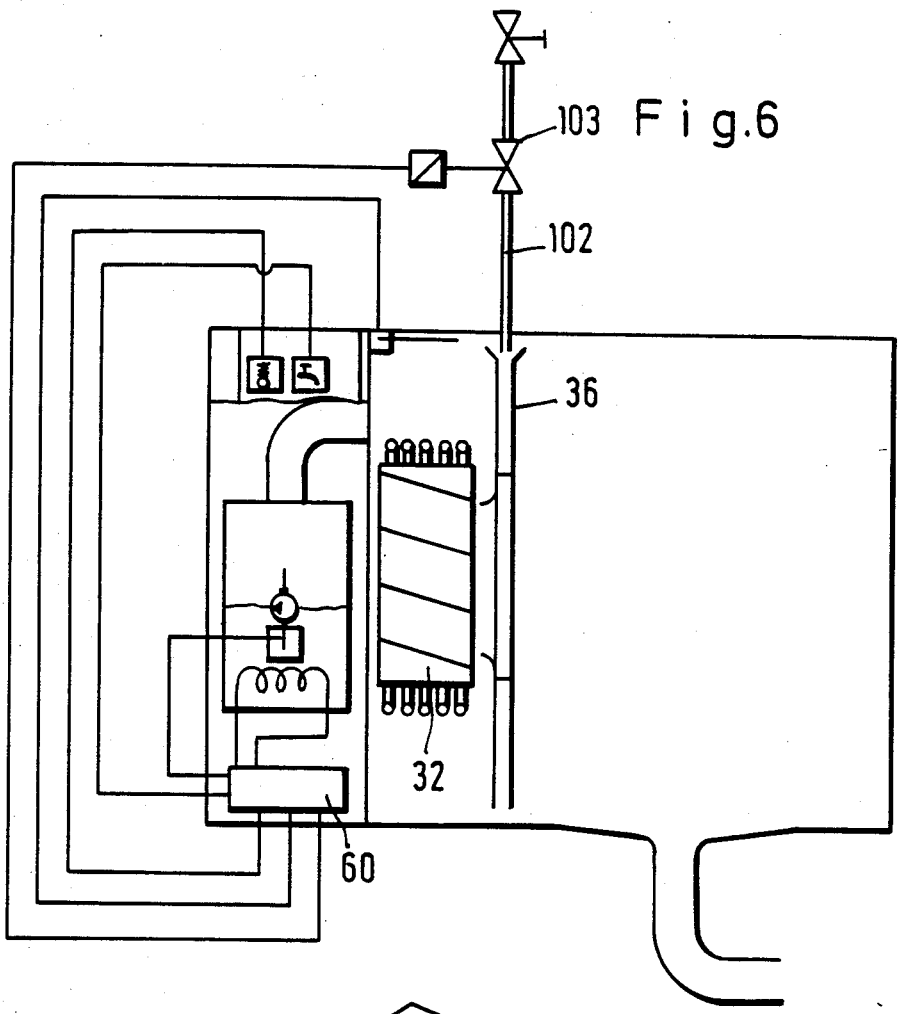
FIG. 6 shows an apparatus according to the invention with a component within the cooking area, constructed as a cooling device.

In the embodiment shown in FIG. 6, a sheet metal plate 36 serving as a flow guidance wall is constructed as a heat exchanger through which can flow a cooling medium, and comparably with the embodiment of FIG. 4 can be subject to the flow action of a cooling medium supply line 102, which is once again provided with a stop valve 103, which can be controlled by control system 60. Cooling by means of the sheet metal plate 36 in the form of a heat exchanger, or some similar component, is advantageous in this case together with an activation of blower 32, which leads to an intense heat exchange between the atmosphere in cooking area 12 and the cooling medium flowing through plate 36.

Figure 7:
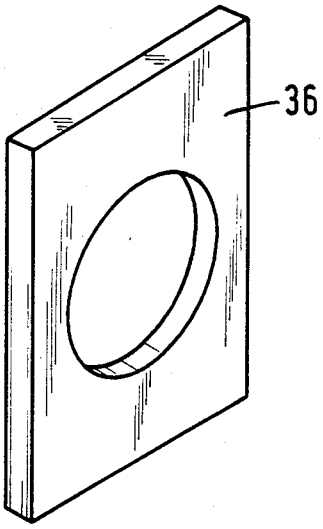
FIG. 7 shows a perspective view of the component shown in FIG. 6.

FIG. 7 perspectively shows the sheet metal plate 36 represented in sectional form in FIG. 6.

In the embodiments of FIGS. 4, 5, 6 and 7, as in the embodiment described hereinafter relative to FIG. 8, the cooling medium particularly compressed air can be supplied from a separate container. On freely blowing out the compressed air, advantageous use can be made of the effect that gases passing out of a relatively small nozzle under an overpressure undergo a temperature drop.

Figure 8:
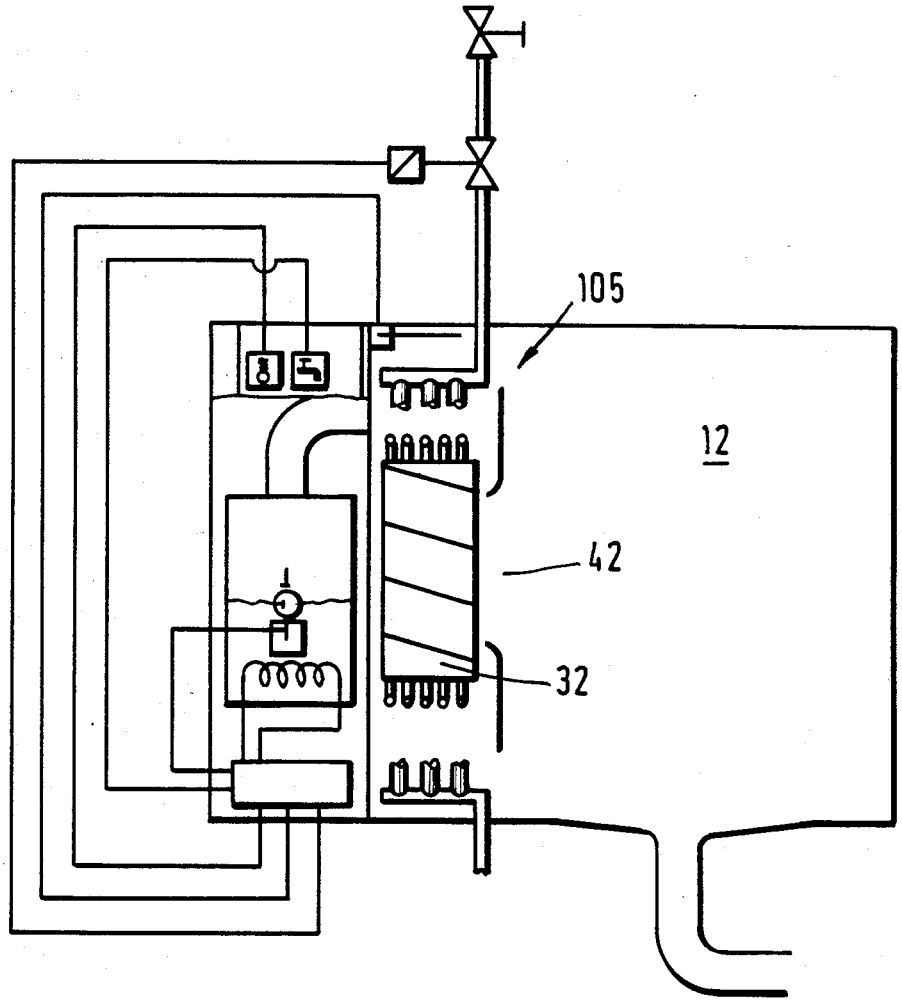
FIG. 8 shows an apparatus according to the invention with a cooling device surrounding a fan wheel.

In the embodiment of FIG. 8, a cooling arrangement 105 surrounding blower 32 is provided, in which the surrounding area of blower 32 is directly cooled. In the case of an activated blower 32, the cooking area atmosphere sucked through suction port 42 from cooking area 12 and which flows out radially from fan 32 again is cooled by cooling arrangement 105 and in this form recirculated in cooking area 12. This is particularly advantageous with a view to cooling the cooking area with its door 10 closed. With respect to the feedline, control system and activation of cooking arrangement 105, the circuitry and control possibilities described hereinbefore relative to the cooling measures again apply, so that reference should be made thereto.

Features of the invention are disclosed in the description, drawings and claims can be important for the realization of the different embodiments of the invention either singly or in random combination.

LIST OF REFERENCE NUMERALS

1 Apparatus
10 Cooking area door
12 Cooking area
13 Part (of 14)
14 Front
16 Operating mode selection switch
17/18/19 Indicator panel
22 Partition
24 Boiler
26 Boiler heating system
28 Steam supply pipe
30 Antechamber
32 Blower
34 Heating coil
36 Sheet metal plate
38 Bottom
40 Top
41 Wall
42 Suction port
43 Wall
44 Heat sensor
46 Water level switch
47 Water surface

48 Tube
49 Water
50 Float
52 Electric line
54/56/58 Two-conductor line
60 Control system (of 1)
61 Lead
62 Line
64/66/68/70 Spraying nozzles
72 water line
74 Valve
76 Water supply line
78 Field coil
80 Electric line
82 Control line
83 Switch arm
84 Electric line
85 Switch arm
86/87/89 Line
90 Electric line
92/94 Light
96 Spraying device
101 Double chamber wall
102 Cooling medium supply line
103 Stop valve
104 Drain line
105 Fan
106 Heat exchanger
B1 Valve
K3/K5 Relay
K6 Relay/working contact
K8/K9 Flashing indicator
OR Reed contact
T Door switch
OR Reed contact

I claim:

1. An apparatus for the selective heat treatment of food, by steam or hot air, having a cooking area, characterized by heating means in said cooking area, and in that signal generator means (94) is provided for indicating a cooking area temperature above a predetermined value before starting a heat treatment, a heat sensor (44) in the cooking area (12) which is operatively associated with said signal generator and the signal generator is subject to the action of the heat sensor (44), and cooling means associated with the cooking area and signal generator for at least partly actively cooling said cooking area to a temperature below said predetermined value so as to minimize burning of food during heat treatment.

2. The apparatus according to claim 1, characterized in that there is provided control circuit means (60) for initiating a specific operating mode and the signal generator (94) is an element of control circuit (60) means.

3. The apparatus according to claim 1 or 2, characterized in that there is provided a heat sensor (44) in the cooking area (12) which is operatively associated with said signal generator and the signal generator (94) is subject to the action of said heat sensor (44).

4. The apparatus according to claim 3, characterized in that the heat sensor (44) is positioned in the vicinity of a cooking area (40).

5. The apparatus according to claim 1 or 2, characterized in that boundary walls (40, 41, 43) of the cooking area (12) are at least partly constructed in the form of a fluid heat exchanger.

6. The apparatus according to claim 1 or 2, characterized in that components (36) in the cooking area (12) are at least partly constructed in the form of a fluid heat exchanger.

7. The apparatus according to claim 5, characterized in that adjacent to the boundary walls (40, 41, 43) and/or the components (36) of the cooling area (12), cooling medium lines are at least partly provided and at least on one side.

8. The apparatus according to one of claims 1 or 2, characterized in that there is provided means for spraying a cooling fluid into the cooking area (12).

9. The apparatus according to claim 8, characterized in that said spraying means comprises spraying nozzles (64, 66, 68, 70) extending into the interior of cooking area (12).

10. The apparatus according to claim 5, characterized in that there is provided means for wetting the boundary walls (40, 41, 43) and components (36) of the cooking area (12) with cooling fluid.

11. The apparatus according to claim 10, characterized in that said wetting means comprises wetting lines extending up to the boundary wall (40, 41, 43), component (36) and issuing into the interior of cooking area (12).

12. The apparatus according to claim 1 or 2, characterized in that an air exchange means (105) is provided for the exchange of the internal atmosphere of cooking area (12) with an ambient atmosphere.

13. The apparatus according to one of the claims 1 to 11, characterized in that there is provided exchange means for replacing the internal atmosphere with a separate cooling atmosphere.

14. The apparatus according to claim 13, characterized in that the cooling atmosphere is compressed air.

15. The apparatus according to claim 1, characterized in that there is provided control circuit means for initiating a specific operating mode as a function of a heat sensor (44) and said cooling means is controlled by said control circuit means.

16. The apparatus according to claim 15, characterized in that the cooling means is connected in parallel with the heat sensor (44).

17. The apparatus according to claim 15, characterized in that the control circuit has a reversing switch (83) electrically connected to the heat sensor and whose switching position is controlled by the heat sensor (44).

18. The apparatus according to claim 15, characterized in that a further switch (UR, OR) is provided in the control circuit and its switching position is controlled by a water level switch (46) arranged in boiler (24).

19. The apparatus according to claim 18, characterized in that the further switch (UR, OR) is connected to a second control circuit, which initiates a combination steaming operating mode.

20. The apparatus according to claim 15, characterized in that the further switch is connected electrically in series with one of two switching contacts of a reversing switch (83).

21. The apparatus according to claim 15, characterized in that a relay (K5) is provided in the circuit of the further switch and connects a switching contact with one of the further switch and an acoustic signal generator (92) in the event the water level is below a predetermined level.

22. An apparatus according to claim 1, wherein said signal generator is optical.

23. An apparatus according to claim 1, wherein said signal generator is acoustic.

24. The apparatus according to claim 10, characterized in that said wetting means comprises wetting lines extending up to the boundary wall (40, 41, 43), and component (36) and issuing into the exterior of cooking area (12).

* * * * *